US007226220B2

(12) United States Patent
Choy et al.

(10) Patent No.: US 7,226,220 B2
(45) Date of Patent: Jun. 5, 2007

(54) CLAMSHELL PACKAGING STRUCTURE

(75) Inventors: Chan Kam Choy, Perak (MY); Poon Hin Fook, Penang (MY); Andy Lenss, Los Gatos, CA (US)

(73) Assignee: Finisar Corporation, Sunnyvale, CA (US)

( * ) Notice: Subject to any disclaimer, the term of this patent is extended or adjusted under 35 U.S.C. 154(b) by 120 days.

(21) Appl. No.: 11/085,857

(22) Filed: Mar. 22, 2005

(65) Prior Publication Data

US 2006/0215978 A1 Sep. 28, 2006

(51) Int. Cl.
*G02B 6/36* (2006.01)
*G02B 6/26* (2006.01)
*H04B 10/00* (2006.01)

(52) U.S. Cl. ..... 385/92; 385/88; 385/89; 385/94; 385/139; 398/135; 398/139; 264/1.24; 264/1.25

(58) Field of Classification Search ..... 385/135, 385/136, 137, 138, 139, 88, 89, 92, 93, 94; 398/135, 139; 264/1.24, 1.25
See application file for complete search history.

(56) References Cited

U.S. PATENT DOCUMENTS

2005/0152701 A1* 7/2005 Liu et al. ..... 398/135
2005/0185897 A1* 8/2005 Duncan ..... 385/92
2005/0238358 A1* 10/2005 Light ..... 398/135
2005/0286901 A1* 12/2005 Sasser et al. ..... 398/135

* cited by examiner

*Primary Examiner*—Brian M. Healy
(74) *Attorney, Agent, or Firm*—Workman Nydegger

(57) ABSTRACT

Packaging for optical components. A package for packaging multiple fiber optical components can include a bottom portion comprising at least two cavities. The cavities can include a first cavity that is sized and configured to receive a first fiber optic component, and a second cavity that is sized and configured to receive a different fiber optic component. The package can also include a lid portion. The lid can be secured in a closed position with the bottom portion. The cavity can receive a first optical component and a second optical component. The package can also include identification information integrated with at least one of the bottom portion and the lid portion for describing the package or a component held within the package.

22 Claims, 7 Drawing Sheets

CLAMSHELL PACKAGING STRUCTURE

BACKGROUND OF THE INVENTION

1. The Field of the Invention

The present invention relates generally to packaging systems and methods. More specifically, embodiments of the present invention relate to systems and methods for packaging fiber optic communication components including optical transceivers.

2. The Relevant Technology

Some of the fundamental components in fiber optic technologies are the components used to transmit and receive the optical signals. These components are typically referred to as transceivers. Transceivers often use lasers to generate the optical signals. Because the transceivers contain lasers, they are often subject to various packaging and labeling requirements.

Conventionally, the packaging of fiber optic components such as transceivers is often carried out using a separate cardboard box for each component. Each box typically includes packaging foam for cushioning the fiber optic component. During the packaging process, each cardboard box is sealed independently of the others using tape or glue. In addition, each box receives a label that is attached to the outside of the box. The labels identify the product in the box and may also include an address to which the component is sent. The resulting packages have typically been expensive to ship and to store at least because of the size of the individual packages, the labor required to assemble the packages, and the amount of material required for each separate component. In addition, the materials that have been historically used for the packaging have not been easily reused or recycled resulting in excess waste and cost in the disposal of the used packaging.

FIGS. 1A, 1B, and 1C illustrate a conventional package for storage and shipment of a transceiver. The package includes a rectangular cardboard box 100 including a flap 110 and tabs 120 for securing the lid 130 of the box in a closed position as shown in FIGS. 1B and 1C. Tape 155 or glue is typically used to close the box 100 and a label 160 for shipping, providing electrostatic discharge (ESD) caution, or for identification and regulatory purposes can be attached to the outside of the box 100.

The box typically includes foam 140 attached to the inside of the box 100 for cushioning the fiber optic component 150 housed therein. Often, these packaging boxes 100 cannot be reused and the box 100 itself cannot be recycled without removing the cushioning foam 140 from within. The current packaging of fiber optic components tends to be bulky and is relatively expensive to ship, store and recycle. Further, it is not readily apparent what part is contained within the packaging without a label or external indication of some sort. The fact that a component was actually placed inside of a conventional package cannot be visually ascertained without opening the package.

BRIEF SUMMARY OF THE INVENTION

The present invention relates to packaging for optical components. A package for packaging multiple fiber optical components can include a bottom portion comprising at least two cavities. The cavities can include a first cavity that is sized and configured to receive a first fiber optic component, and a second cavity that is sized and configured to receive a second fiber optic component, wherein the second fiber optic component is a different fiber optic component than the first fiber optic component. The package can also include a lid portion including means for securing the lid in a closed position with the bottom portion.

A packaging structure is described including a cavity molded into a bottom portion, the cavity receiving one or a first optical component and a second optical component, wherein a first portion of the cavity is shaped substantially similar to an outer profile of the first optical component and a second portion of the cavity is shaped substantially similar to an outer profile of the second optical component. The packaging structure can also include a lid portion connected with the bottom portion and means for providing identification information integrated with at least one of the bottom portion and the lid portion.

A method for manufacturing a package for packaging optical components is described. The package can include a bottom portion and a lid portion. The method can include molding a cavity into the bottom portion of the package, wherein a first portion of the cavity is shaped substantially similar to a first optical type of transceiver, and a second portion of the cavity is shaped substantially similar to a second type of optical transceiver that is a different type of optical transceiver than the first optical transceiver, and wherein the first portion of the cavity has a depth greater than a depth of the second portion of the cavity such that the first portion of the cavity receives the first optical transceiver in a first orientation and the second portion of the cavity receives the second optical transceiver in a second orientation that is different from the first orientation.

BRIEF DESCRIPTION OF THE DRAWINGS

To further clarify the advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The principles of the present invention are described with reference to the attached drawings to illustrate the structure and operation of example embodiments used to implement the present invention. Using the diagrams and description in this manner to present the invention should not be construed as limiting its scope. Additional features and advantages of the invention will in part be obvious from the description, including the claims, or may be learned by the practice of the invention.

Figure 2C:
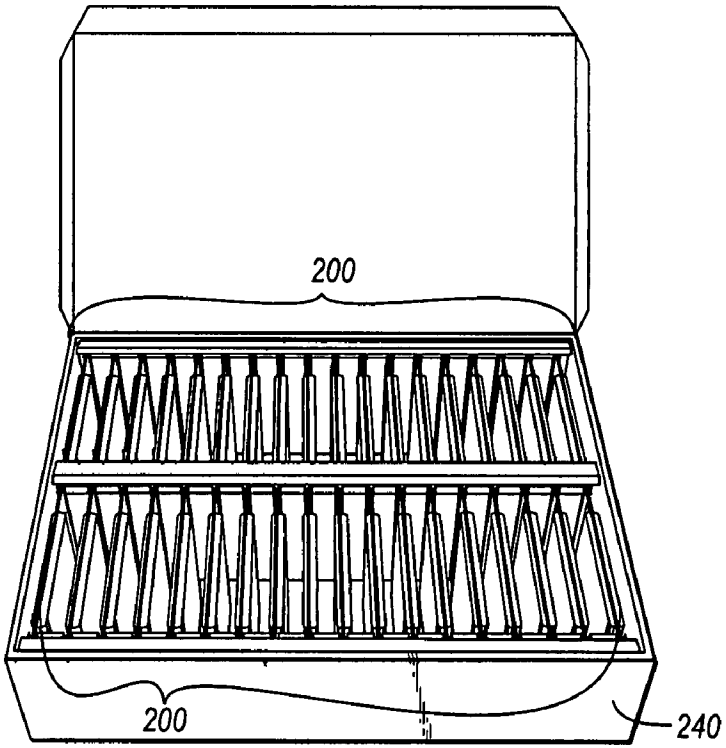
FIG. 2C illustrates multiple clamshell packages stacked within an intermediate ESD box according to an example embodiment of the present invention.
Figure 2B:
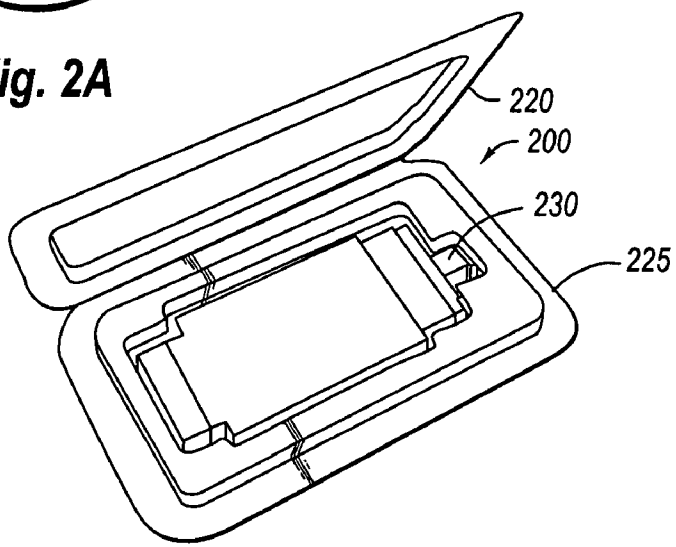
FIG. 2B illustrates a clamshell packaging housing a GBIC transceiver according to an example embodiment of the present invention.
Figure 2A:
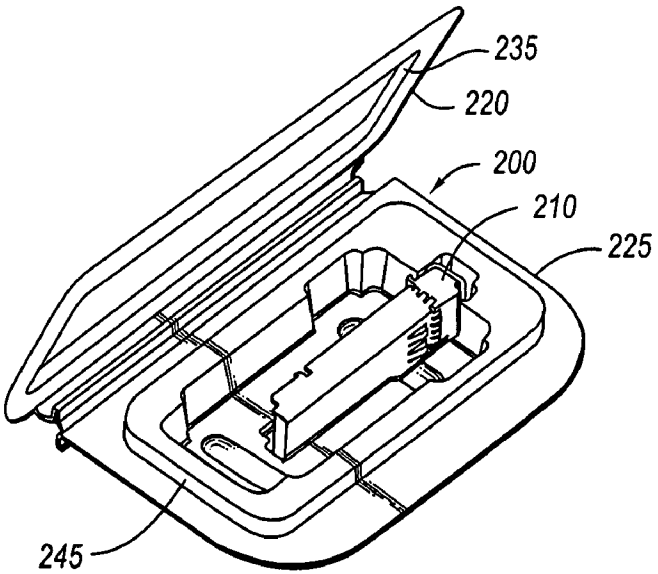
FIG. 2A illustrates a clamshell packaging housing a SFP transceiver according to an example embodiment of the present invention.

FIGS. 2A, 2B, and 2C illustrate one embodiment of clamshell packaging for packaging optical components. In this example, FIGS. 2A, 2B, and 2C illustrate clamshell packaging 200 for both small form factor pluggable (SFP) transceivers and gigabit interface converter (GBIC) transceivers. The clamshell package 200 is configured to meet the packaging needs of more than one type of component in a single package. In this case, the clamshell package is designed to hold either a SFP or a GBIC transceiver in the same clamshell package 200 design.

Referring to FIG. 2A, the clamshell packaging 200 is shown housing a SFP transceiver 210. The clamshell package 200 includes a lid portion 220 that is shown in the open position. The lid 220 can be integral with a bottom portion 225 as shown, or the lid 220 can be separate from the bottom portion 225 of the package. The lid 220 can be manufactured using a molding process along with the integral bottom portion 225 or the lid 220 can be separate from the bottom portion 225 and manufactured using the same or different manufacturing process as that used to manufacture the bottom portion 225.

The SFP transceiver 210 is placed in the center of the clamshell package 200 and the lid 220 of the clamshell package 200 can be closed securing the SFP transceiver 210 in the clamshell package 200 in a secure manner. The clamshell package 200 can be shaped so as to secure the SFP transceiver 210 in a form-fitting manner. The clamshell package 200 can include protrusions and cavities so as to cushion and protect the SFP transceiver 210 within the clamshell package 200. The lid 220 of the clamshell packaging 200 can be secured in a closed position using any appropriate means. For example, a snap fit engagement using friction fit engagements between portions of the clamshell packaging 200 can be used for securing the lid 220 of the clamshell package 200 in a closed position. For example, an internal wall portion 235 of the lid 220 can engage with an external wall portion 245 of the bottom portion 225

Referring now to FIG. 2B, the same clamshell package 200 is shown housing a GBIC transceiver 230. The clamshell package 200 can include a lid portion 220 that is shown in the open position. The GBIC transceiver 230 can be placed flat inside the clamshell package 200 above a cavity where the SFP transceiver was received in FIG. 2A. Referring still to FIG. 2B, the lid 220 of the clamshell package 200 can be closed against the bottom portion 225 securing the GBIC transceiver 230 within the clamshell package 200 in a secure manner. The clamshell package 200 can include protrusions and cavities that can be shaped and configured to secure the GBIC transceiver 230 in a form-fitting and secure and protected manner. The clamshell packaging 200 can include cavities and protrusions for accommodating the different sizes and shapes of transceivers or other fiber optic components in a single packaging design. The clamshell packaging can include cavities for protecting particular portions of a transceiver that are prone to damage.

The same clamshell package 200 can securely hold two different types and shapes of transceivers. Moreover, the clamshell package 200 can be configured to include multiple cavities for holding multiple transceivers at one time. In the example of FIGS. 2A and 2B, the clamshell packaging 200 is shaped and sized to hold a SFP transceiver 210 that is placed in the clamshell vertically or a GBIC transceiver 230 horizontally. This is accomplished by two sets of moldings formed in the clamshell package 200. A deeper molding is shaped and configured to hold one optical component (e.g. the SFP transceiver 210) in a particular orientation. A more shallow molding is shaped and configured to hold a different optical component (e.g. the GBIC transceiver 230) in a different orientation within the clamshell. The deeper molding can be adapted to the specific dimensions of the first optical component (e.g. the SFP transceiver 210) and the shallow molding can be adapted to the specific dimensions of the second optical component (e.g. the GBIC transceiver 230). In this manner, the same clamshell packaging 200 is adapted to securely hold more than one type of optical component. In other embodiments, the clamshell packaging 200 can be adapted to securely package other types of optical components, such as a 10 gigabit small form factor pluggable (XFP) transceiver for example which are well known to one of ordinary skill in the art, or multiple transceivers of any type, in addition to or in place of the SFP 210 and GBIC 230 transceivers described above.

The present invention can present several advantages over the prior art. For example, one advantage of some embodiments is that the clamshell packaging 200 may enable more transceivers to be stored in a smaller space than conventional packaging. Referring now to FIG. 2C, several GBIC/SFP clamshell packages 200 are shown stored in a single intermediate ESD box 240. In this manner only one label is required on the intermediate ESD box 240 and only the ESD box 240 requires tape. This reduces packaging costs. Further, more of the packaging materials can be recycled. A single ESD box 240 can be used for shipping multiple clamshell packages 200, which can be readily reused or recycled. Further, removal of foam for packaging each transceiver can be eliminated. As shown in FIG. 2C, multiple transceivers can be stored in secured clamshell packages 200 and held in the single ESD box 240 in a compact and space efficient manner. A plurality of transceivers can be held in a single ESD box 240 in any number and configuration desired for storage, shipping, or any other purpose.

Another advantage of certain embodiments of the clamshell package 200 is that the type of transceiver held within the clamshell package 200 can be readily apparent because the clamshell package 200 can be made from an at least partially transparent plastic material such as polyethylene terephthalate (PET). Thus, where the transceiver itself includes sufficient identification information attached thereto, an additional label may not be necessary on the outside of the clamshell package 200 to identify the contents of the clamshell package 200. Further, the clamshell package 200 can be designed such that it is stackable independently of the ESD box 240. Information identifying the transceiver held inside of the clamshell as well as other information can also be displayed on an area of the clamshell package 200, such as a tab of each clamshell package 200. The tab can protrude from the clamshell packaging 200 such that a particular part held therein can be readily identified and located from a stack of clamshell packages 200.

In addition, the clamshell package 200 can be made from a material that is easily recyclable. It can be appreciated that the clamshell package 200 may be reused where it has not been overly deformed or damaged. For example, where the clamshell package 200 is made from PET, the clamshell package material itself can be recycled in an environmentally conscious manner. PET is plastic with good clarity, good moisture barrier and tends to be impact resistant. Clamshell packages 200 made from PET can be available in a great range of colors, sizes and shapes. The color, size and shape of a clamshell package 200 can also identify the components contained within or the configuration of the clamshell package 200. There are also many closure options available with the PET. For example, press-fit friction closure features can be incorporated at various locations in the clamshell package 200 for placing the clamshell package lid 220 in a closed and secure position.

Figure 3:
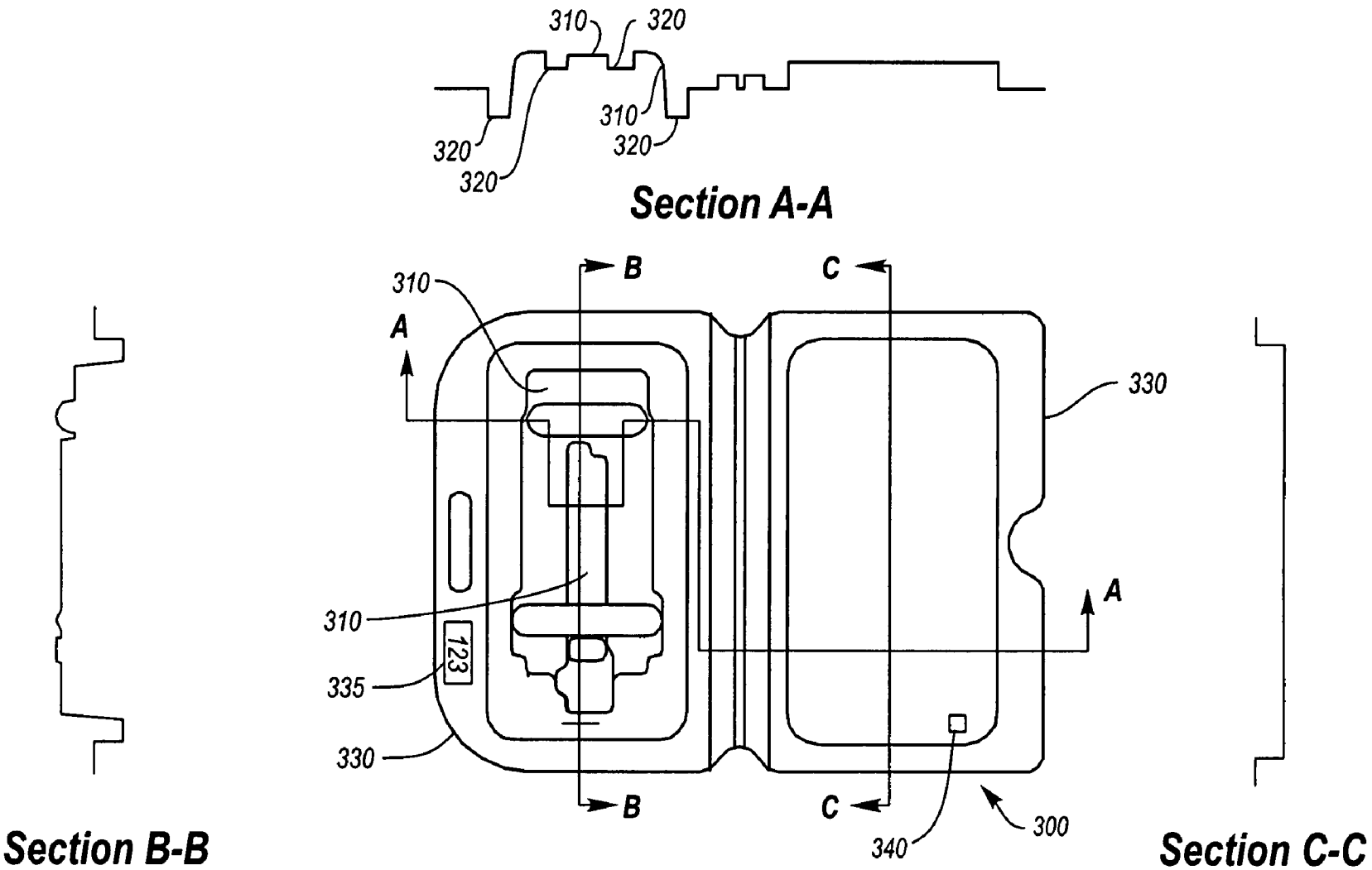
FIG. 3 illustrates a mechanical drawing of a clamshell GBIC/SFP package o at according to an example embodiment of the present invention.

Referring now to FIG. 3, a mechanical schematic of an example embodiment of a GBIC/SFP transceiver clamshell package 300 is shown. It should be appreciated that a clamshell package 300 for different optical components than those specified herein, but known to one of ordinary skill in the art, is included within the scope of other embodiments of the present invention. The clamshell package 300 shown in FIG. 3 and described in further detail herein is one advantageous embodiment of the present invention. As shown, the clamshell package 300 can include cavities 310 and protrusions 320 for receiving, cushioning, protecting, and securing either a SFP transceiver or a GBIC transceiver. One of skill in the art can appreciate that the cavities 310 and protrusions 320 can be adapted for any number and type of optical components including other transceiver types such as XFP transceivers.

The clamshell package 300 can include means for providing information. For example, the clamshell package 300 can include tab portions 330 or other areas of the package for displaying identification information such as a part number, serial number, manufacturer's name, operational characteristics and parameters of the component, a date of production, recycleability of the package or other desirable information. The information can be displayed upon any area of the package 300 such as a tab 330, or the information can be incorporated into any portion of the structure of the package 300 such as by stamping or molding processes. For example, the clamshell package 300 can include an area 335 on one of the tabs 300 for displaying molded in information identifying the component held therein.

The clamshell package 300 can also include other means for providing identification information. The identification information can be used to prevent counterfeiting of the components held therein. For example, the clamshell packaging 300 can include optical identification means such as a barcode, letters and words, figures, or colored material for optically identifying the components held within the clamshell package 300. The optical identification means can be observable by a human, or can be only detectable by a machine or other apparatus. For example, the optical identification means can include fluorescent material that produces an emission when irradiated by a particular spectrum that is not otherwise observable by a human. The spectrum of the optical emission can include a plurality of spectrums and intensities of spectrums providing a spectral "barcode" in which information can be encoded. For example, the emission can include a particular spectrum or combination of spectrums to indicate the type of component or origin of the component held therein for example. The spectrum(s) (and relative intensities between spectrums) to make up a spectral barcode and can be selected by a selection of dyes, colored plastics, taggants, quantum dots, paints, and other means for emitting a desired spectrum(s).

The clamshell package 300 can also include radio frequency identification (RFID) means or other signaling means for providing identification of the components contained within the clamshell package 300. RFID is a method of remotely storing and retrieving data using devices often called RFID tags. An RFID tag 340 can be attached, coupled to, or incorporated into the clamshell package. The RFID tag 340 can be a small object, such as an adhesive sticker, that can be attached to or incorporated into the clamshell package. RFID tags 340 can contain antennas to enable them to receive and respond to radio-frequency queries from an RFID transceiver or other device. The RFID tag 340 can provide any information about the package or component(s) held therein. The RFID tag 340 or optical identification means can also be placed in a single ESD box containing multiple clamshell packages 300 (e.g. ESD box 240 in FIG. 2C).

The identification information provided can indicate any number of information about the component(s) contained within the clamshell package 300, their origin, the clamshell package 300 itself, or any other type of useful information. For example, the information provided can indicate at least one of the manufacturer of the fiber optic component held within the clamshell package 300 or a manufacturer of the package 300, the location of the manufacture of the fiber optic component or of the clamshell package 300, the year of manufacture of the fiber optic component or of the clamshell package 300, the model of the fiber optic component, operational characteristics of the fiber optic component, the manufacturer of the fiber optic component or the manufacturer of a component of the fiber optic component or of the clamshell package 300, the location of the manufacture of the fiber optic component or a component of the fiber optic component, the year of manufacture of the fiber optic component, the model of the fiber optic component, and operational characteristics of the fiber optic component.

Because the fiber optic component can be shipped within such a clamshell package 300, a customer may be able to more readily identify counterfeit components that have not been shipped in a package providing such identification information. A counterfeiter may be required not only to counterfeit such fiber optic components, but also counterfeit the identifying aspects of the clamshell package 300 as well, which can be periodically changed if desired.

The clamshell package 300 can be manufactured using any appropriate number and type of manufacturing process, such as molding processes. The clamshell package 300 can be inspected for conformity with design specifications, cleanliness, and ESD concerns in mind to protect the components stored therein.

Figure 1B:
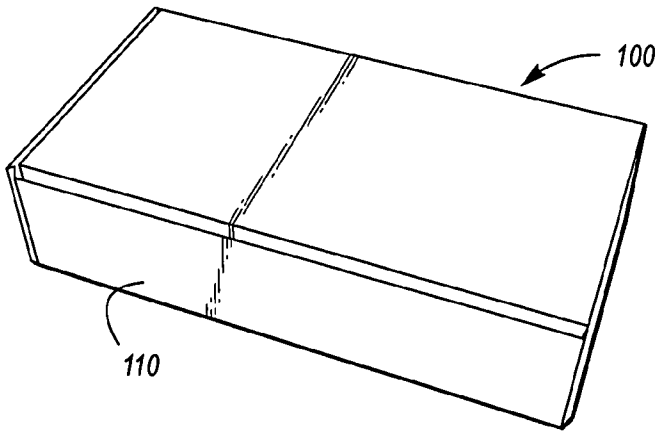
Fig. 1B (Prior Art)
FIGS. 1A, 1B, and 1C illustrate conventional packaging of fiber optic components such as SFP and GBIC transceivers.
Figure 1A:
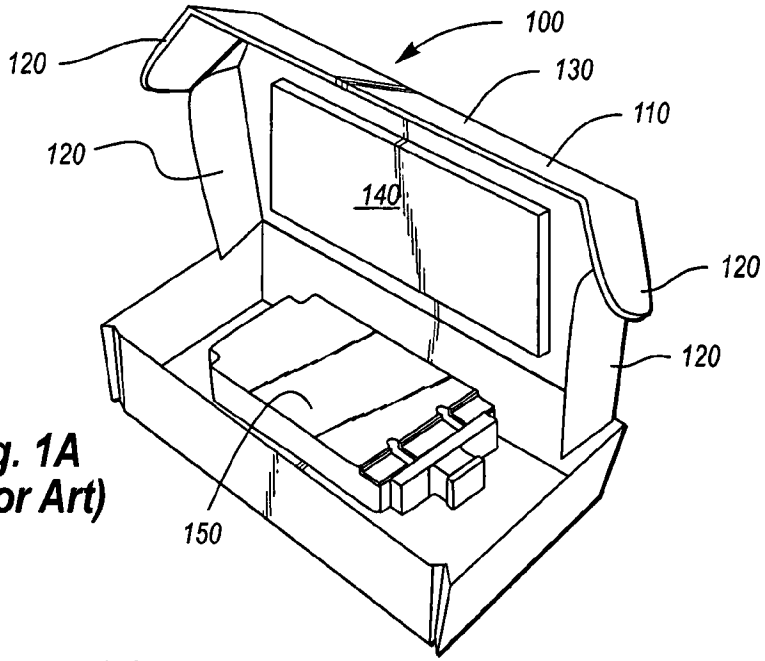
Fig. 1A (Prior Art)
Figure 1C:
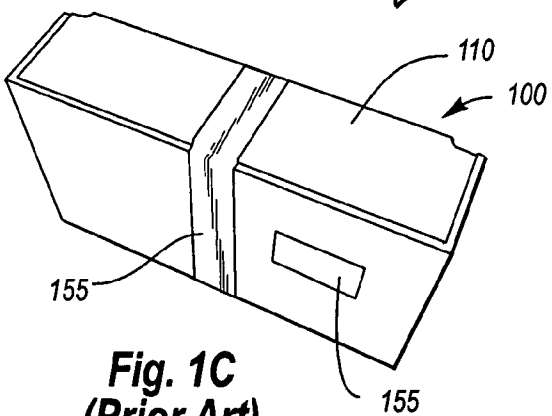
Fig. 1C (Prior Art)

In many instances the clamshell package 300 shown may save as much as 25% or more of the volume for storage and shipping as the conventional box package discussed above with reference to FIGS. 1A, 1B, and 1C. In addition, the cost of manufacturing the clamshell package 300 will often be less than the cost associated with a conventional cardboard box with foam cushioning.

Figure 4B:
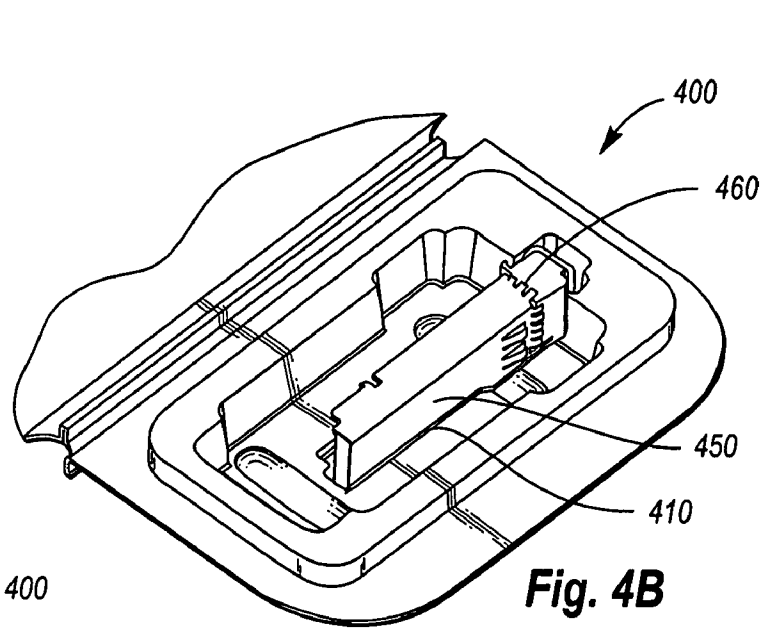
FIG. 4B illustrates a partial perspective view of a clamshell GBIC/SFP package housing a SFP module according to an example embodiment of the present invention.
Figure 4A:
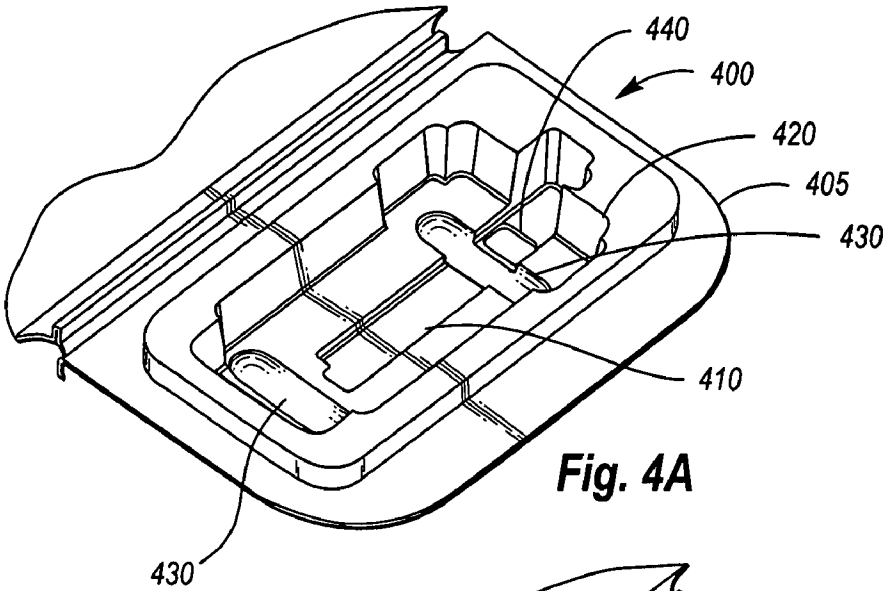
FIG. 4A illustrates a partial perspective view of a clamshell GBIC/SFP package according to an example embodiment of the present invention.

Referring now to FIG. 4A, a bottom portion 405 of an empty clamshell package 400 is shown from a partial perspective view. The clamshell package 400 includes various cavities and protrusions for accommodating and protecting two different transceiver designs. The clamshell package includes a deeper molded-in cavity 410 shaped and configured to receive, protect, and house a first type of transceiver and a shallower molded-in cavity 420 that is shaped and configured to receive, protect, and house a second type of transceiver. Both the deeper cavity 410 and shallower cavity 420 are shaped and configured to conform to the shape of the applicable transceiver that the cavity is designed to accommodate. The clamshell package 400 can also include additional cavities for protection of particular portions of the transceivers housed therein and also for providing rigidity to the clamshell packaging. For example, the clamshell packaging can include rib protrusions 430 for protecting and cushioning the components held within the clamshell packaging 400 and also for providing additional strength to the clamshell packaging 400. The ribs 430 can also provide a support and leveling structure for the clamshell package 400 when the clamshell package 400 is placed flat on a table or other level surface. Without the ribs 430, in some instances the clamshell package 400 may also be prone to warping or other undesirable deformation. As such, the ribs 430 can act as a strengthening feature for adding rigidity to the clamshell package 400.

The clamshell package 400 can also include cavities for protection of any feature of a module that is particularly fragile or prone to damage in packaging. For example, the clamshell can include a fin protection cavity 440 for protecting the fins of an SFP type module. The fin protection cavity 440 can be sized and configured to create a cavity for receiving and protecting the fins of a SFP module, or any other portion of a module that may be particularly prone to damage.

Referring now to FIG. 4B, a clamshell package 400 is shown containing a SFP module 450 in a centered and upright position. The SFP module 450 can be contained at least partially within and held by the deeper molded-in cavity 410. As shown, the deeper molded-in cavity 410 can be shaped and configured to conform to an outer profile of the SFP module 450. The fin protection cavity (not visible) receives a fin portion 460 of the SFP module 450 and protects the fin portion 460 of the SFP module 450 from damage.

Figure 4C:
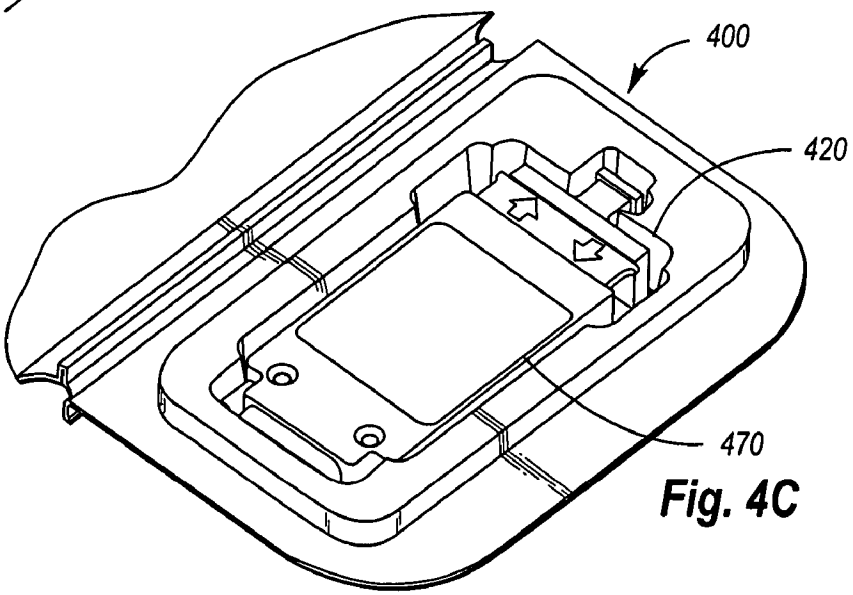
FIG. 4C illustrates a partial perspective view of a clamshell GBIC/SFP package housing a GBIC module according to an example embodiment of the present invention.

Referring now to FIG. 4C, a clamshell package 400 is shown containing a GBIC module 470 in a centered and relatively flat position. The GBIC module 470 is contained by and held by the shallower molded-in cavity 420 of the clamshell package 400. As shown, the shallower molded-in cavity 420 is shaped and configured to conform to an outer profile of the GBIC module 470. It should be appreciated that the clamshell packaging 400 can include any number of cavities and protrusions for protecting the modules held therein and also for providing rigidity for the clamshell packaging 400.

Figure 5:
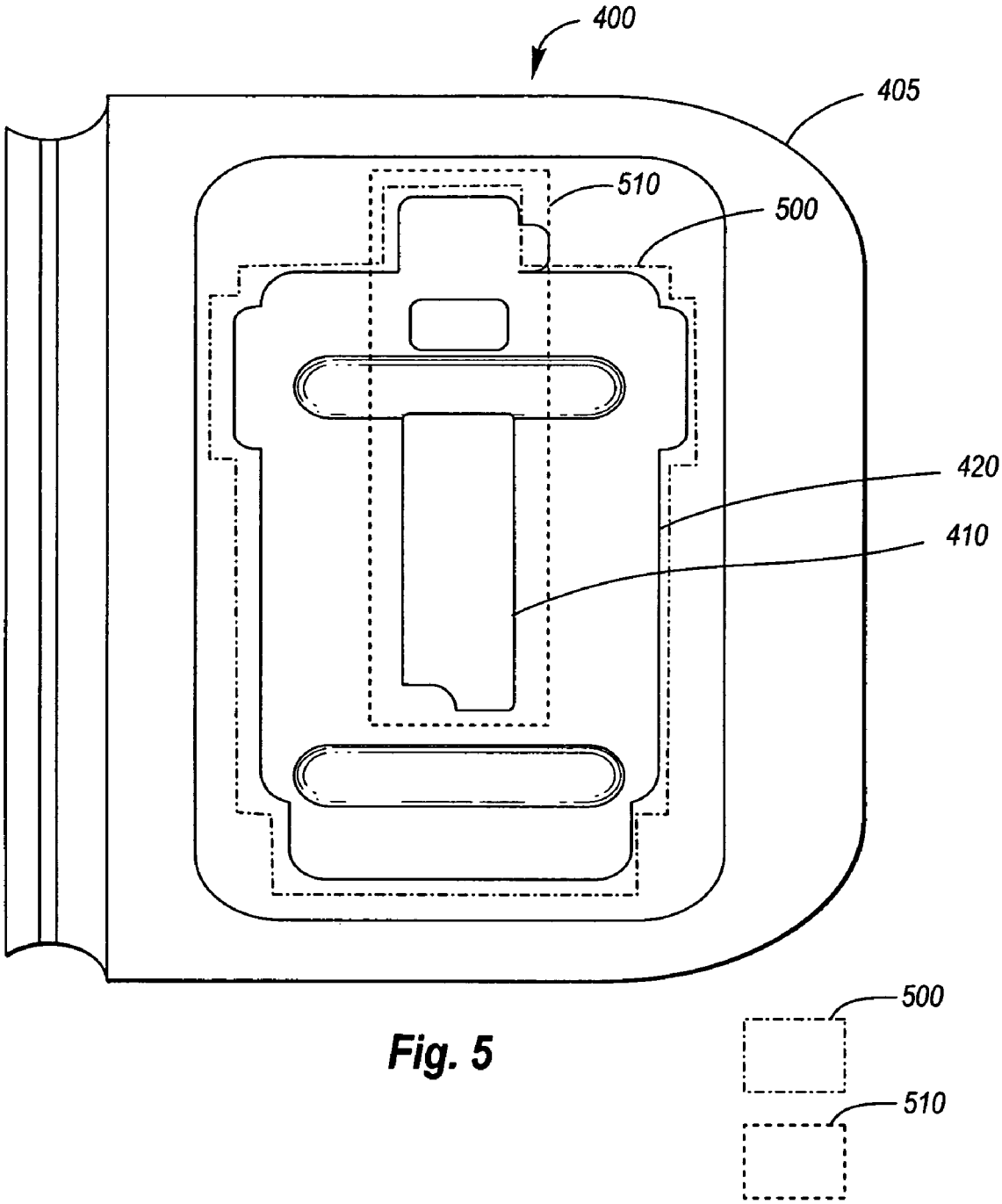
FIG. 5 illustrates a clamshell GBIC/SFP package depicting outlines defining cavities for holding GBIC and SFP modules.

Referring now to FIG. 5, a top view of the bottom portion 405 of the clamshell package 400 is shown including outlines about the molded-in cavities 410 and 420 for receiving and protecting the different transceiver designs. As shown, the deeper molded-in cavity 410 is outlined by dashed line 510 for receiving a SFP module within the clamshell package. The shallower molded-in cavity 420 is outlined by dashed 500 defining the cavity for receiving a GBIC module.

Figures 6A, 6B:
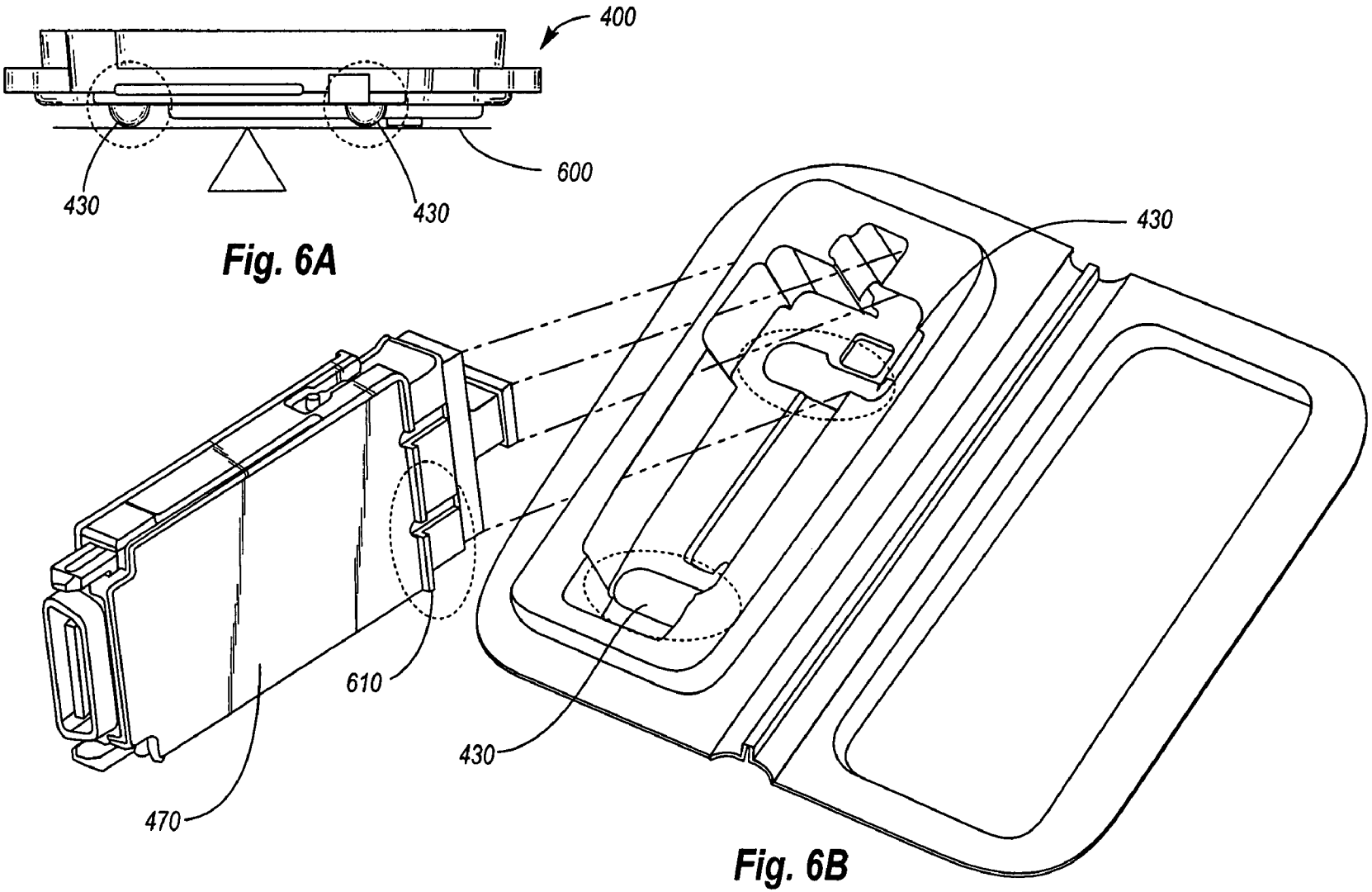
FIG. 6A is a side perspective view of a clamshell GBIC/SFP package according to an example embodiment of the present invention.
FIG. 6B is a partial perspective view of a GBIC module and a clamshell GBIC/SFP package according to an example embodiment of the present invention.

Referring now to FIG. 6A, the leveling effect of the molded-in ribs 430 is shown illustrating how protrusions can be implemented to locate and orient the clamshell package 400 with respect to external objects according embodiments of the present invention. It should be appreciated that the leveling effect of the molded-in ribs 430 with respect to a flat and straight outside surface 600 can be altered to orient the clamshell package 400 with respect to any outside surface, such as other similar clamshell packages. Referring now to FIG. 6B, the protection and strengthening benefits of the molded-in ribs 430 is illustrated. The molded-in ribs 430 can serve multiple purposes of positioning the package with respect to external objects, strengthening the package, and protecting portions of optical components stored therein, for example by being positioned and configured to accommodate a rib portion 610 of the GBIC module 470. The molded-in rib 430 can protect the rib portion 610 and also provides rigidity and positioning benefits for the clamshell package 400.

Figure 7B:
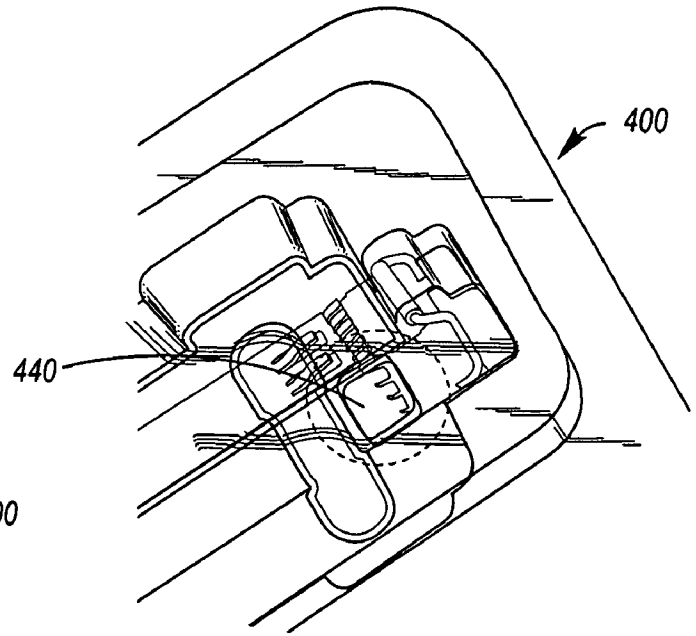
FIGS. 7A, 7B, and 7C are partial perspective views of a SFP module and a clamshell GBIC/SFP package according to an example embodiment of the present invention.
Figure 7C:
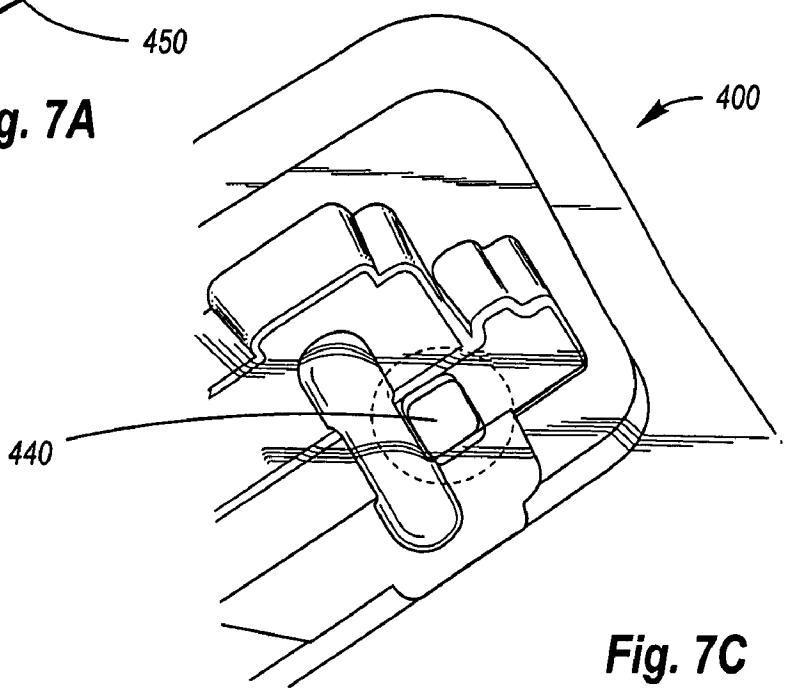
Figure 7A:
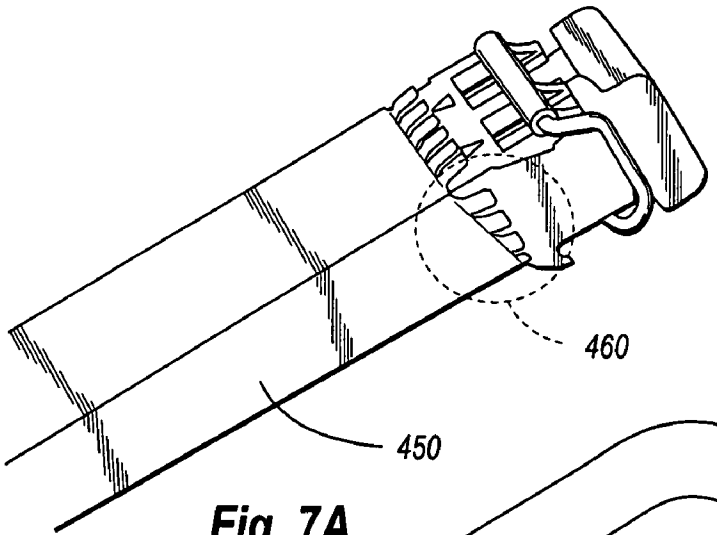

Referring now to FIGS. 7A, 7B, and 7C, the fin protection cavity 440 is shown receiving the fin feature 460 of the SFP module 450. The fin protection cavity 440 receives the fin feature 460 and provides sufficient clearance such that the fin feature 460 of the SFP module 450 is protected from damage by an external force to this portion of the clamshell package 400. It should be appreciated that any number or configuration of protection features can be incorporated in the clamshell package 400 design to protect features of the modules housed therein from potentially damaging external forces. The location of the protection features can be determined based on risks of damage to a particular module by an impact to the portion of the module housed within the clamshell package 400.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A package for packaging multiple fiber optical components, the package comprising:

a bottom portion comprising at least two cavities, the cavities comprising:

a first cavity that is sized and configured to receive a first fiber optic component; and a second cavity that is sized and configured to receive a second fiber optic component, wherein the second fiber optic component is a different fiber optic component than the first fiber optic component; and a lid portion including means for securing the lid in a closed position with the bottom portion, wherein the bottom portion and the lid portion comprise polyethylene terephthalate (PET).

2. The package of claim 1, wherein the first fiber optic component is a first type of transceiver and the second fiber optic component is a second type of transceiver, wherein the first type of transceiver is a different type of transceiver than the second type of transceiver.

3. The package of claim 2, wherein the first and second transceivers are each a different one of a small form factor pluggable (SFP) transceiver, a gigabit interface converter (GBIC) transceiver and a 10 gigabit small form factor pluggable (XFP) transceiver.

4. The package of claim 1, further comprising:

identification information included in at least one of the bottom portion and the lid portion.

5. The package of claim 4, wherein the identification information comprises at least one of:

a tab identification;

a barcode;

a color;

a fluorescent emission; and a radio frequency identification (RFID).

6. The package of claim 4, wherein the identification information is incorporated into the package using a molding process.

7. The package of claim 4, wherein the identification information is coupled to the package using glue or adhesive to attach the identification providing means to the package.

8. The package of claim 1, wherein the first cavity and second cavity are molded into the package and wherein the first cavity is molded into the package deeper than the second cavity is molded into the package.

9. The package of claim 1, wherein the second cavity is located above the first cavity and the second cavity is wider than the first cavity.

10. The package of claim 1, wherein the package includes a protection cavity configured to protect a portion of one of the optical components.

11. The package of claim 1, wherein the package includes a rib for orienting the package with respect to an external object.

12. The package of claim 1, wherein the package includes a rib for providing rigidity to the package.

13. A packaging structure comprising:

a bottom portion;

a cavity molded into the bottom portion, the cavity receiving a first optical component and a second optical component, wherein a first portion of the cavity is shaped substantially similar to an outer profile of the first optical component, and a second portion of the cavity is shaped substantially similar to an outer profile of the second optical component;

a lid portion connected with the bottom portion; and means for providing identification information integrated with at least one of the bottom portion and the lid portion.

14. The packaging structure of claim 13, the cavity further comprising:

one or more ribs located at a bottom of the cavity, the one or more ribs extending out from the bottom of the cavity, the one or more ribs providing rigidity; and a protection cavity placed in the bottom of the cavity to protect a portion of at least one of the first optical component and the second optical component.

15. The packaging structure of claim 13, wherein the means for providing identification information comprises at least one of:

an optical identification providing means;

a signal identification providing means;

a tab identification;

a barcode;

a color;

a fluorescent emission; and a radio frequency identification (RFID).

16. The packaging structure of claim 13, wherein the first portion of the cavity has a depth greater than a depth of the second portion of the cavity such that the first portion of the cavity receives the first optical component in a vertical orientation and the second portion of the cavity receives the second optical component in a horizontal orientation.

17. The packaging structure of claim 14, wherein at least one of the first optical component and the second optical component is a SFP transceiver, XFP transceiver, or GBIC transceiver.

18. A method for manufacturing a package for packaging optical components, the package comprising a bottom portion and a lid portion, the method comprising:

molding a cavity into the bottom portion of the package, wherein a first portion of the cavity is shaped substantially similar to an outer profile of a first type of optical transceiver, and a second portion of the cavity is shaped substantially similar to an outer profile of a second type of optical transceiver that is a different type of optical transceiver than the first optical transceiver, and wherein the first portion of the cavity has a depth greater than a depth of the second portion of the cavity such that the first portion of the cavity receives the first optical transceiver deeper within the cavity than the second portion of the cavity receives the second optical transceiver.

19. The method of claim 18, further comprising:

manufacturing the package to provide at least one of the following:

an optical identification;

a signal identification;

a tab identification;

a barcode;

a color;

a fluorescent emission; and a radio frequency identification (RFID).

20. The package of claim 13, wherein the means for providing identification information is incorporated into the package using a molding process.

21. The package of claim 13, wherein the package includes a rib configured to orient the package with respect to an external object.

22. The package of claim 13, the first optical component is a first type of transceiver and the second optical component is a second type of transceiver, wherein the first type of transceiver is a different type of transceiver than the second type of transceiver, wherein the cavity is configured to encase each of the first and second types of transceivers including the housings of the first and second types of transceivers.

* * * * *